US006904719B2

(12) United States Patent
Braun

(10) Patent No.: US 6,904,719 B2
(45) Date of Patent: Jun. 14, 2005

(54) STORAGE ATTACHMENT FOR DECK RAILING

(76) Inventor: J. Richard Braun, 6 Juxon Ct., Baltimore, MD (US) 21236-2624

( * ) Notice: Subject to any disclaimer, the term of this patent is extended or adjusted under 35 U.S.C. 154(b) by 30 days.

(21) Appl. No.: 10/385,370

(22) Filed: Mar. 10, 2003

(65) Prior Publication Data

US 2004/0177567 A1 Sep. 16, 2004

(51) Int. Cl.[7] ..... E04H 14/00

(52) U.S. Cl. ..... 52/27; 52/720.2; 52/79.1; 312/242; 312/245; 256/22; 256/1; 446/476; 446/75; 446/76

(58) Field of Search ..... 52/720.2, 27, 79.1; 312/242, 245, 220, 345.1; 256/22, 1, 19; 446/476, 75, 76, 73

(56) References Cited

U.S. PATENT DOCUMENTS

| | | | | | |
|---|---|---|---|---|---|
| ,645,124 | A | | 3/1900 | Plumb | 312/201 |
| 1,068,391 | A | | 7/1913 | Jensen | 248/214 |
| 1,280,109 | A | | 9/1918 | Silverton | 312/101 |
| 1,285,158 | A | | 11/1918 | Haynes | 126/505 |
| 2,199,194 | A | * | 4/1940 | Cohen | 312/229 |
| 2,602,584 | A | * | 7/1952 | Croft, Jr. | 232/43.1 |
| 3,017,155 | A | | 1/1962 | Scarpetti | 248/235 |
| 3,744,645 | A | | 7/1973 | Hochman | 211/126 |
| D264,655 | S | * | 6/1982 | Keller | 312/204 |
| 4,336,673 | A | * | 6/1982 | Duchesne et al. | 52/27 |
| 4,372,425 | A | | 2/1983 | Murphy | 182/179 |
| 4,429,850 | A | | 2/1984 | Weber et al. | 248/250 |
| 4,662,519 | A | * | 5/1987 | Ciociola | 206/457 |
| 4,869,378 | A | | 9/1989 | Miller | 211/94 |
| 4,869,451 | A | | 9/1989 | Gordon | 248/235 |
| 4,893,363 | A | | 1/1990 | Huff | 4/496 |
| 4,906,058 | A | * | 3/1990 | Turner | 312/245 |
| 4,934,642 | A | | 6/1990 | Baron et al. | 248/250 |
| 4,949,924 | A | | 8/1990 | Carmody | 248/215 |
| 5,120,262 | A | * | 6/1992 | Caine | 446/476 |
| D335,592 | S | * | 5/1993 | Barthelmess et al. | 312/204 |
| 5,267,715 | A | | 12/1993 | Owen | 248/235 |
| 5,429,252 | A | | 7/1995 | Liu | 211/94 |
| 5,718,493 | A | * | 2/1998 | Nikolai | 312/245 |
| 5,749,623 | A | * | 5/1998 | Mistry et al. | 297/281 |
| 6,267,461 | B1 | * | 7/2001 | Dunagan et al. | 312/49 |
| 6,604,328 | B1 | * | 8/2003 | Paddock | 52/93.1 |
| 6,612,551 | B1 | * | 9/2003 | Roy | 256/1 |

* cited by examiner

*Primary Examiner*—Brian E. Glessner
*Assistant Examiner*—Nahid Amiri
(74) *Attorney, Agent, or Firm*—Whiteford, Taylor & Preston, LLP; Jeffrey C. Maynard; Gregory M. Stone

(57) ABSTRACT

A storage shed for attaching to the railing at the edge of a deck, such shed having an enclosure assembly mounted on the deck railing while being held in place by doors. The shed preserves deck floor space by hanging principally within and on the outside of the deck railing, and provides a stable storage container that may securely hold a variety of items. The shed can be finished to match the deck or the building to which the deck is attached. A plurality of shelves, hooks, drawers, pegboard, hangers, and partitions within the shed can be arranged for convenient storage of a variety of items.

18 Claims, 10 Drawing Sheets

STORAGE ATTACHMENT FOR DECK RAILING

BACKGROUND OF THE INVENTION

1. Field of the Invention

This invention relates generally to storage cabinets. In particular, the present invention relates to a storage cabinet that can be attached to a deck railing.

2. Background of the Prior Art

Storage of gardening tools, patio items, and pool equipment, such as flowerpots, potting tools, lawn sprinklers, barbeque tools and supplies, etc. has been a long existing problem. Since exposure to sunlight and weather elements has an adverse effect on such equipment, it is preferable to store them in an enclosure to improve their lifespan. Additionally, keeping such items neatly put away where they can be readily located and retrieved when one wishes to use them is generally desirable for convenience. Still further, providing a secure location where such items may be kept is likewise desirable. Typically, such items are stored in a garage, basement, or shed located some distance from where the items are put into use. It is therefore desirable to store such items in an easily accessible enclosed container that is located near where the items will be used.

Many storage containers for gardening equipment and barbecue supplies are short, trunklike enclosures without compartments in which such tools and equipment are haphazardly stored. Tall items, such as brooms and rakes do not fit easily in such containers. Items that are meant to be stored hanging cannot be appropriately accommodated. Likewise, many such storage containers are of limited stability and easily moved, toppled, or damaged. Moreover, even when such storage containers are located on a patio deck for ease of access, they take up a fair amount of floor space, which is generally unfavored.

The need for additional useful space in limited areas is well known. For example, U.S. Pat. No. 3,744,645 to Hochman discloses an auxiliary shelf for attachment to an existing shelf to increase storage and display space. U.S. Pat. No. 645,124 to Plumb discloses a provision box that is designed to be hung outside a window for storage of items. U.S. Pat. No. 1,280,109 to Silverton discloses a refrigerator that is designed to be hung outside a window for storage of chilled items. U.S. Pat. No. 1,068,391 to Jensen and U.S. Pat. No. 5,267,715 to Owen both disclose brackets that can be hung from a railing, such as can be found surrounding a patio deck. None of the references, however, disclose a storage shed that can be installed on the railing around a deck and that provides easy and convenient access to stored items.

From the foregoing, it is apparent that there is a need for a storage attachment that can be fitted to a deck railing so as to minimize encroachment on useable deck space, and that provides for secure storage of a variety of items, for example, garden tools, patio items, pool equipment, and the like, and which is cost effective and easy to install but of greater stability than prior known storage containers.

SUMMARY OF THE INVENTION

The present invention provides a solution to the above and other problems by enabling a simply designed, easy to construct storage shed that provides easy access to frequently used items while preserving deck floor space.

It is an object of the present invention to provide a storage shed that fits most deck railings. It is a related object of the present invention to provide a storage shed that is attached to the deck railing. It is a further related object of the present invention to provide a storage shed that incorporates the deck railing into the internal shelving.

It is another object of the present invention to provide a storage shed that is appropriately sized to accommodate patio, garden, and pool items.

It is another object of the present invention to provide a storage shed that complements the existing finish of the deck.

This invention relates to a novel storage shed that can be attached to the railing at the edge of a deck. The shed hangs on the deck railing and incorporates the deck rail cap as a stationary shelf within the shed. Once installed on the deck railing, doors are fastened to the front face of the shed to aid in preventing the shed from falling off the deck railing.

The storage shed disclosed herein offers adjustable shelving, customizable compartmentation, and durable storage to the purchasing public. Such shed may be made from a variety of materials, for example, wood, plastic, or metal to fit framing applications and strength requirements. Moreover, such storage shed may be finished to match the deck on which it is installed or the structure to which the deck is attached. The invention enables a storage shed for attachment to a deck railing that can be mass-produced and sold for a reasonable price that, in fact, can be made or put in place by any skilled or semi-skilled person.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
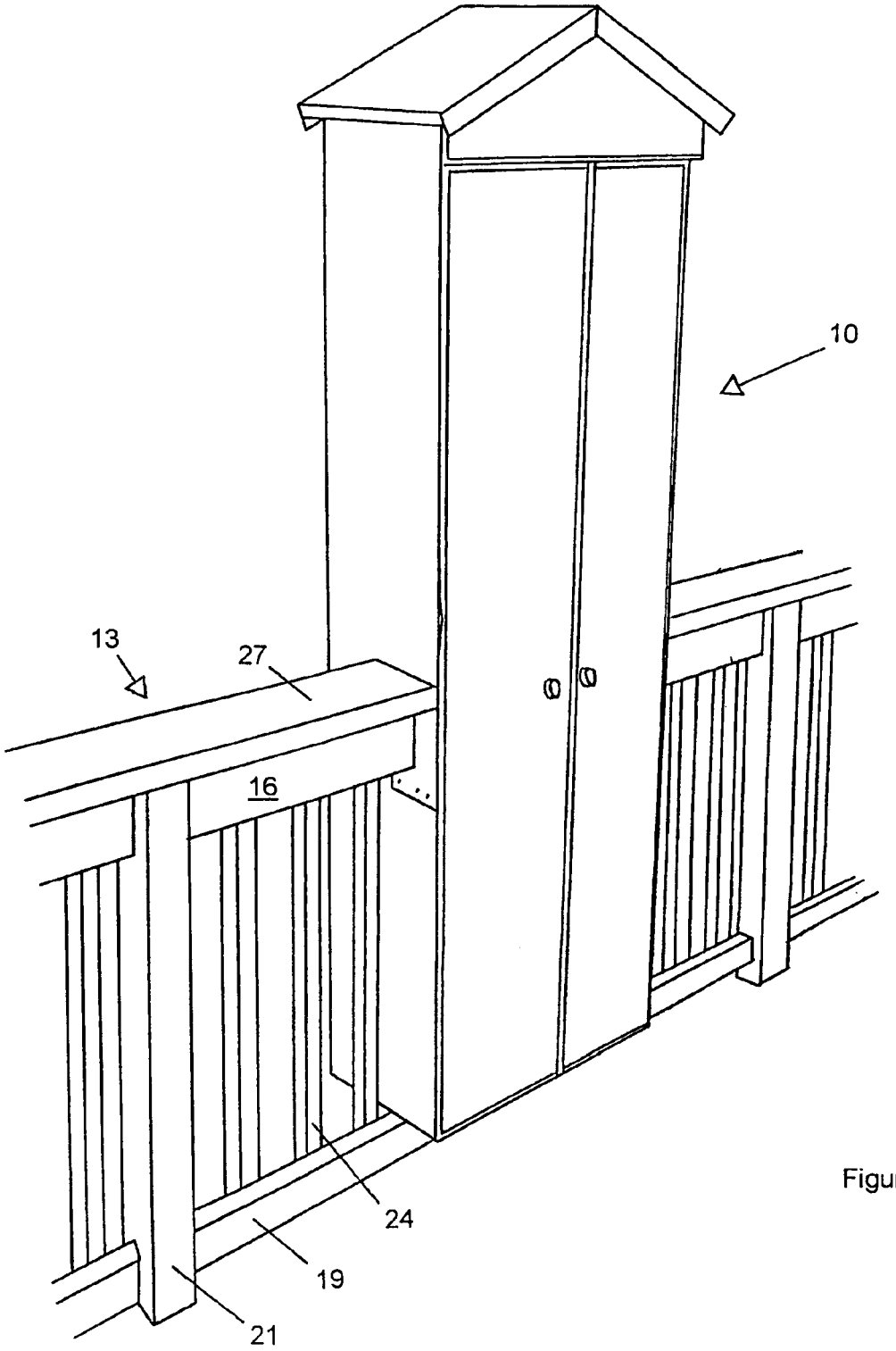
FIG. 1 shows an illustration of a storage shed in perspective according to one embodiment of the present invention.

Referring to FIG. 1, a shed 10 according to the present invention is shown attached to a deck railing 13. The deck railing 13 is generally comprised of a top rail 16, bottom rail 19, railing posts 21, and balusters 24. Top rail 16 is usually covered by rail cap 27 substantially perpendicular to top rail 16. Rail cap 27 may be a standard 2×6 or 2×4 piece of lumber and is ordinarily aligned over top rail 16 such that top rail 16 is centered under rail cap 27 or top rail 16 is positioned toward the deck side of rail cap 27. Railing construction is generally known in the art.

Figure 2A:
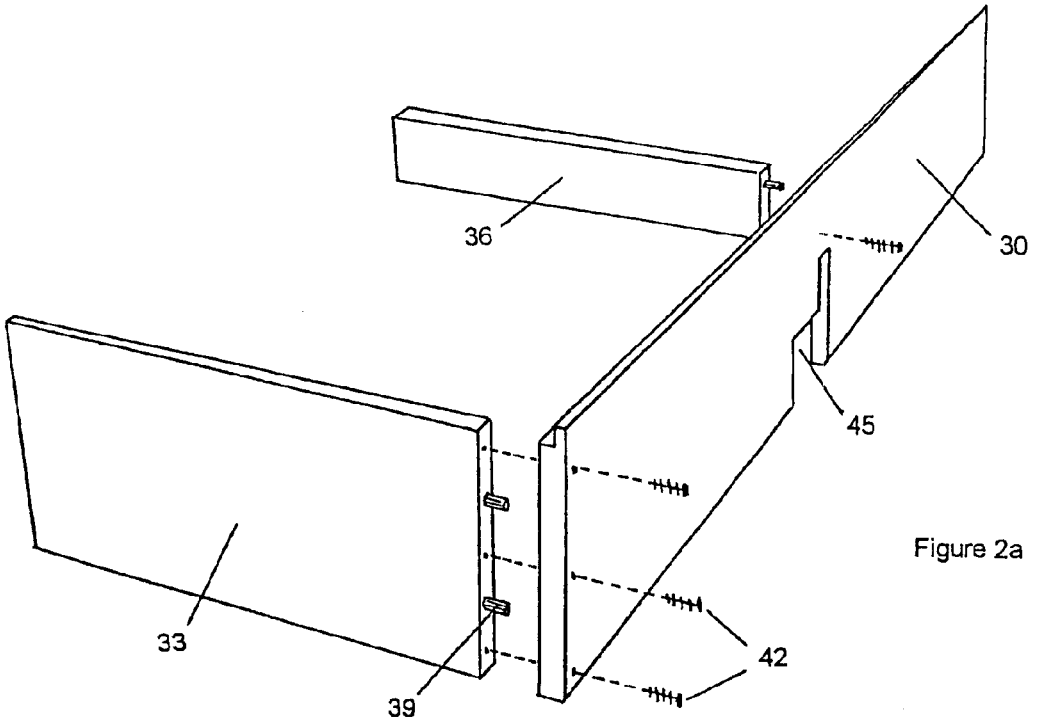
FIGS. 2*a* and 2*b* show an exploded view of a portion of the storage shed of FIG. 1, according to one embodiment of the present invention.

FIG. 2*a* shows a portion of shed 10. Left side panel 30 is attached to bottom panel 33 and center support 36. In a preferred embodiment, short dowels, such as 39, are used to align bottom panel 33 and center support 36 with left side panel 30. As is conventional in the art, such dowels 39 may be attached using a suitable adhesive, such as wood glue and the like. Bottom panel 33 and center support 36 are firmly attached to left side panel 30 using suitable fasteners, such as a plurality of screws 42.

Left side panel 30 presents an opening 45, sized and configured to enable panel 30 to fit snugly on rail cap 27 and against top rail 16, as described in greater detail below.

Center support 36 is selectively provided depending on the size of rail cap 27. If rail cap 27 comprises a 2×6 board, then a smaller center support 36 is necessary than if rail cap 27 comprises a 2×4 board. In use, center support 36 is juxtaposed to rail cap 27 to form a shelf within shed 10, as explained in greater detail below.

Figure 2B:
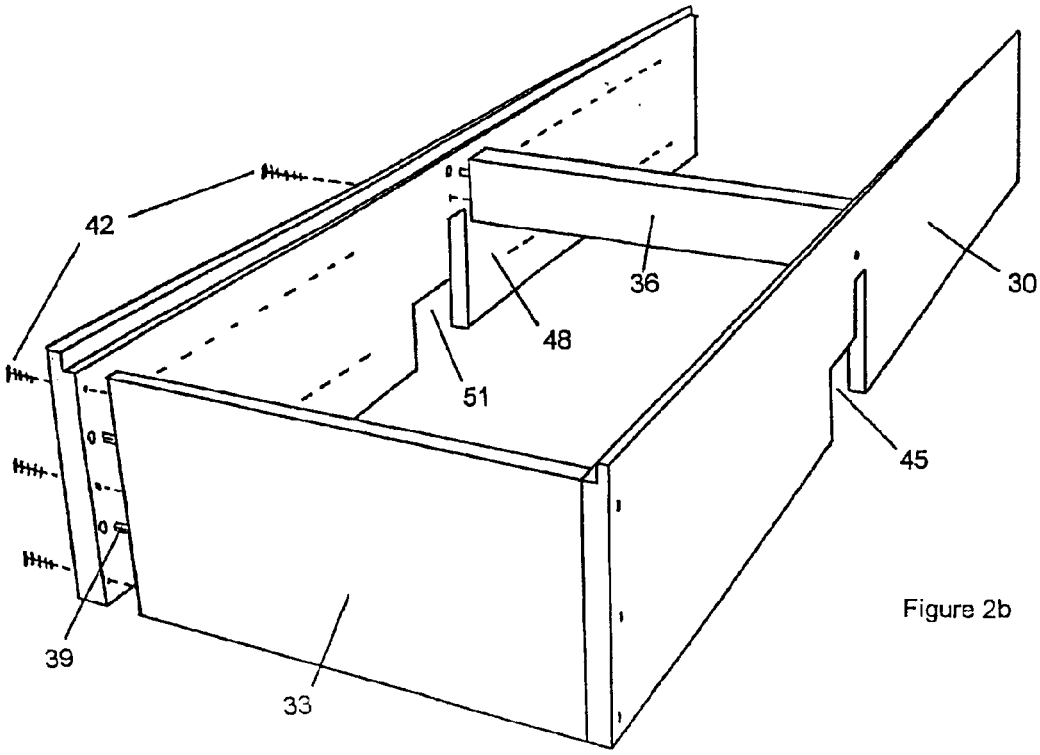

Right side panel 48 is similarly attached to bottom panel 33 and center support 36 using dowels 39, adhesive, and fasteners 42, as shown in FIG. 2*b*. Right side panel 48 also presents an opening 51, sized and configured to enable panel 48 to fit snugly on rail cap 27 and against top rail 16.

Figure 3:
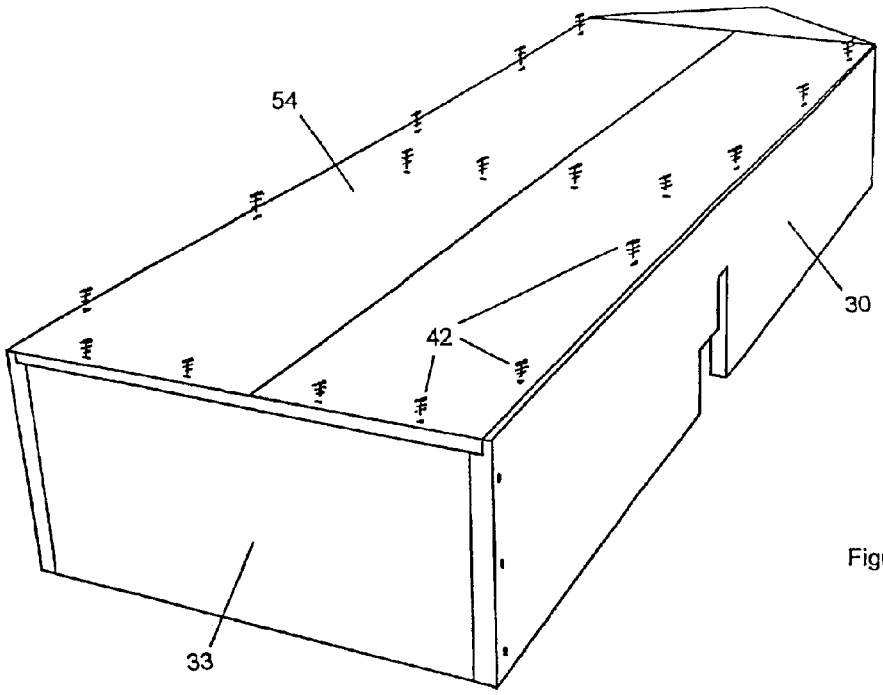
FIG. 3 shows a rear perspective illustration of the storage shed of FIG. 1, according to one embodiment of the present invention.

FIG. 3 shows a rear perspective illustration of storage shed 10 with back panel 54 in place. Back panel 54 is attached to left side panel 30, right side panel 48, bottom panel 33, and center support 36 using a plurality of fasteners 42. Back panel 54 may comprise a single piece or a plurality of pieces fastened together.

Figure 4A:
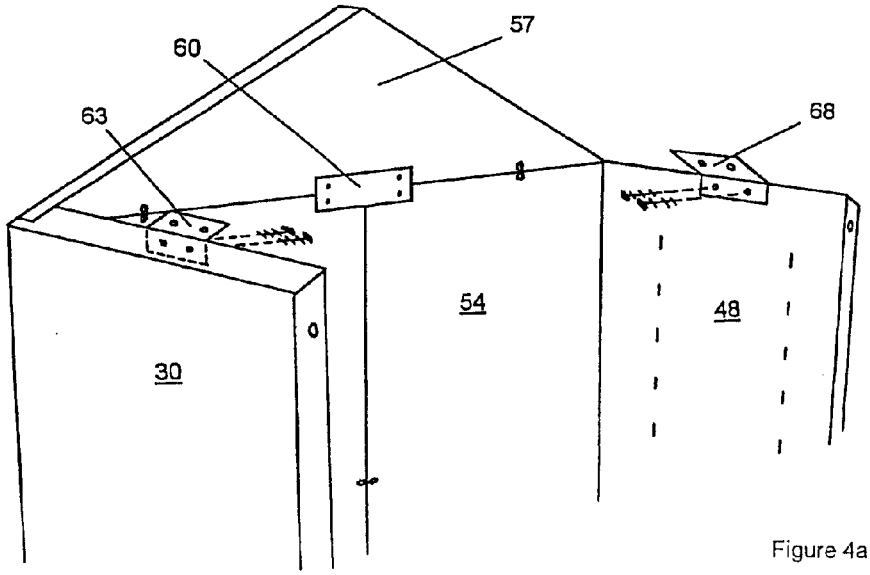
FIGS. 4*a*, 4*b*, and 4*c* show a perspective illustration of a top portion of the storage shed of FIG. 1, according to one embodiment of the present invention.

In one embodiment, back gable 57 is separately attached to back panel 54 using a flat plate 60 and a plurality of suitable fasteners, as shown in FIG. 4*a*. Wide-angled brackets 63, 68 are attached to an inner surface of left and right side panels 30, 48, respectively.

Figure 4B:
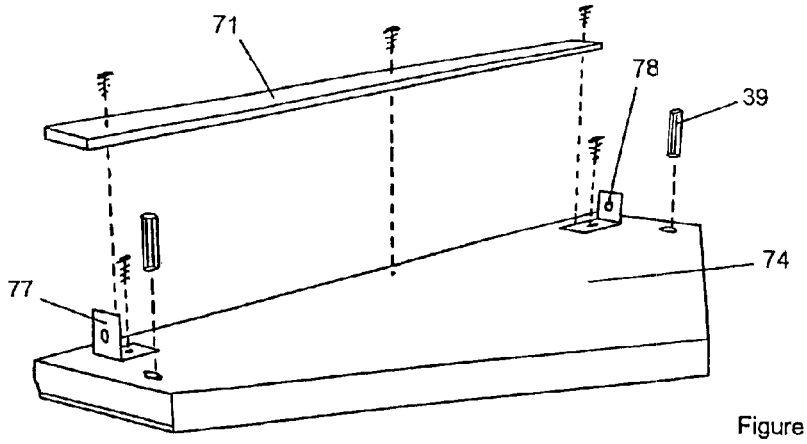
Figure 4C:
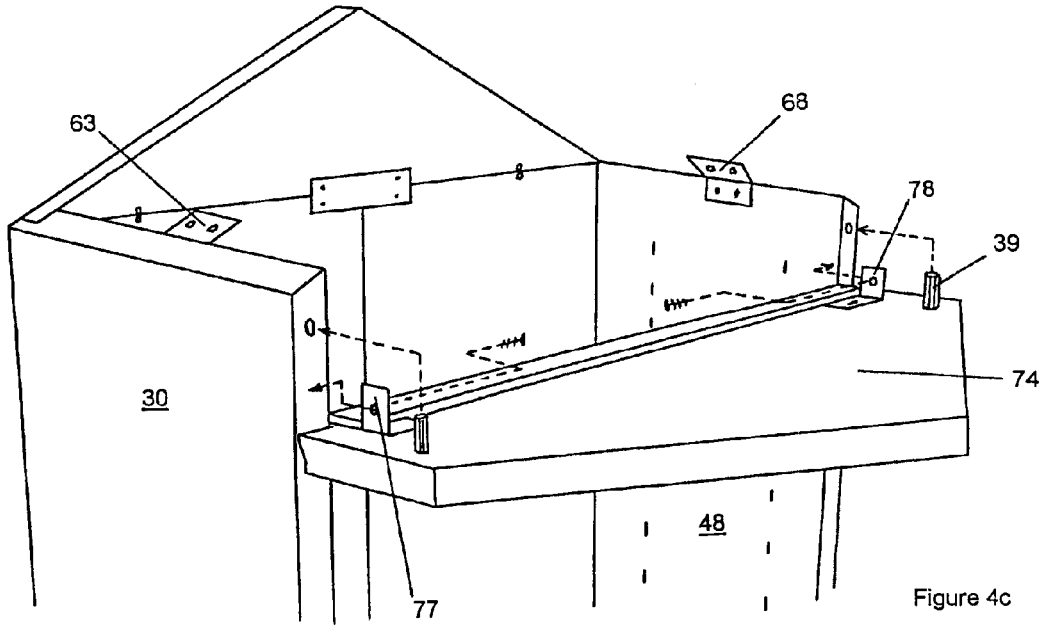

As shown in FIG. 4*b*, a gable door edge piece 71 is attached to an interior surface of front gable 74 using suitable fasteners, such that a portion of the door edge piece 71 extends below a lower edge of the front gable 74. Right-angled brackets 77, 78 are also attached to an interior surface of front gable 74 using suitable fasteners. In a preferred embodiment, short dowels, such as 39, are used to align front gable 74 with left and right side panels 30, 48. As is conventional in the art, such dowels 39 may be attached using a suitable adhesive, such as wood glue and the like. As shown in FIG. 4*c*, front gable 74 is attached to left and right side panels 30, 48. A first right-angled bracket 77 is secured to an interior surface of left side panel 30 and a second right-angled bracket 78 is secured to an interior surface of right side panel 48, using suitable fasteners.

Figure 5:
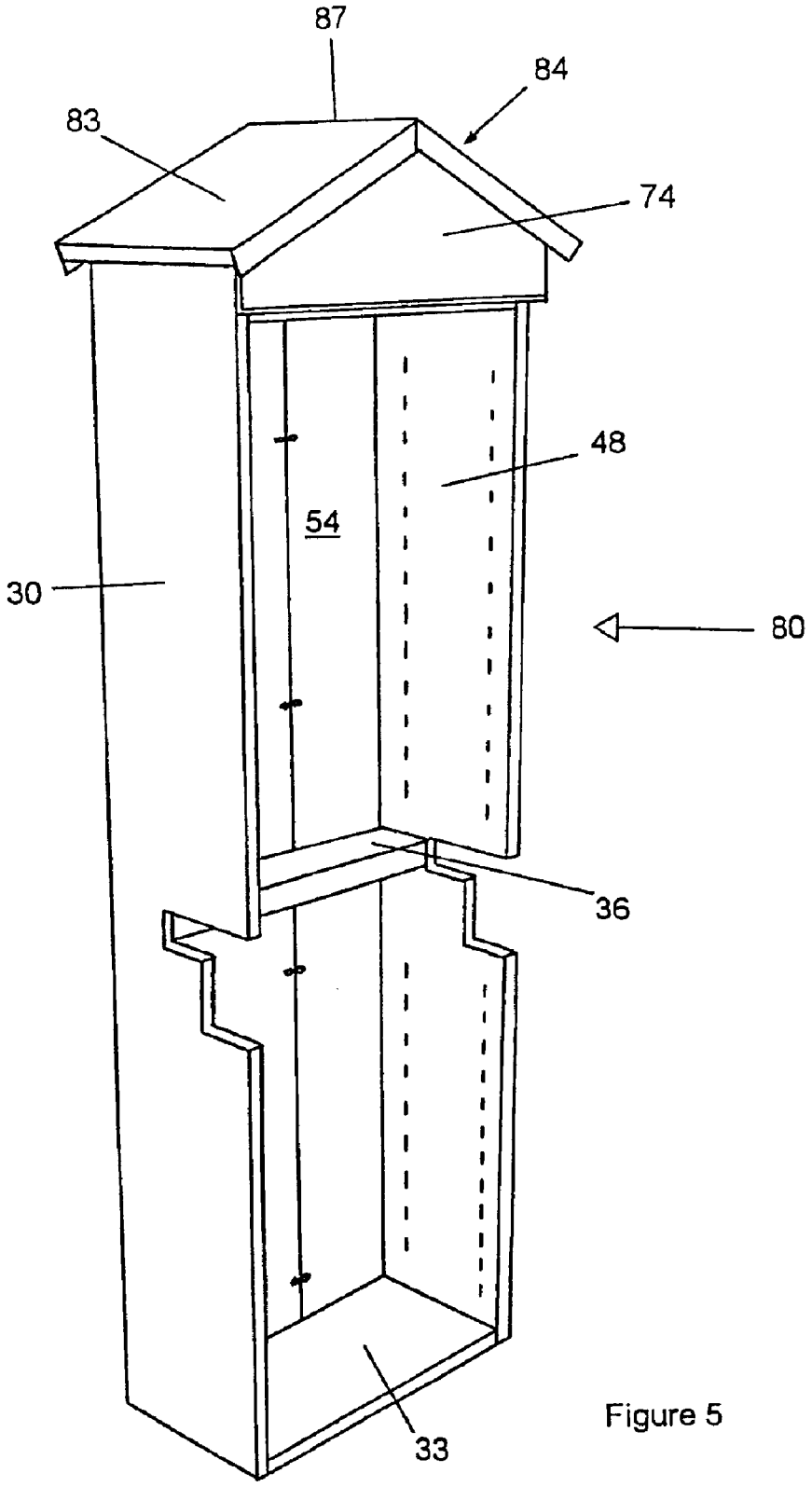
FIG. 5 shows a cutaway illustration of the storage shed of FIG. 1, prior to installation.

FIG. 5 shows a shed enclosure assembly, indicated generally as 80. Enclosure assembly 80 comprises left side panel 30, right side panel 48, bottom panel 33, back panel 54, back gable 57 (not shown), front gable 74, and roof panels 83, 84. Roof panels 83, 84 are attached to back gable 57 and front gable 74 using suitable fasteners. Roof panel 83 is also attached to wide-angled bracket 63 interiorly of enclosure assembly 80 and roof panel 84 is similarly attached to wide-angled bracket 68 interiorly of enclosure assembly 80. In a preferred embodiment, the peak 87 between roof panels 83, 84 can be sealed using caulk or other suitable sealant.

Figure 6:
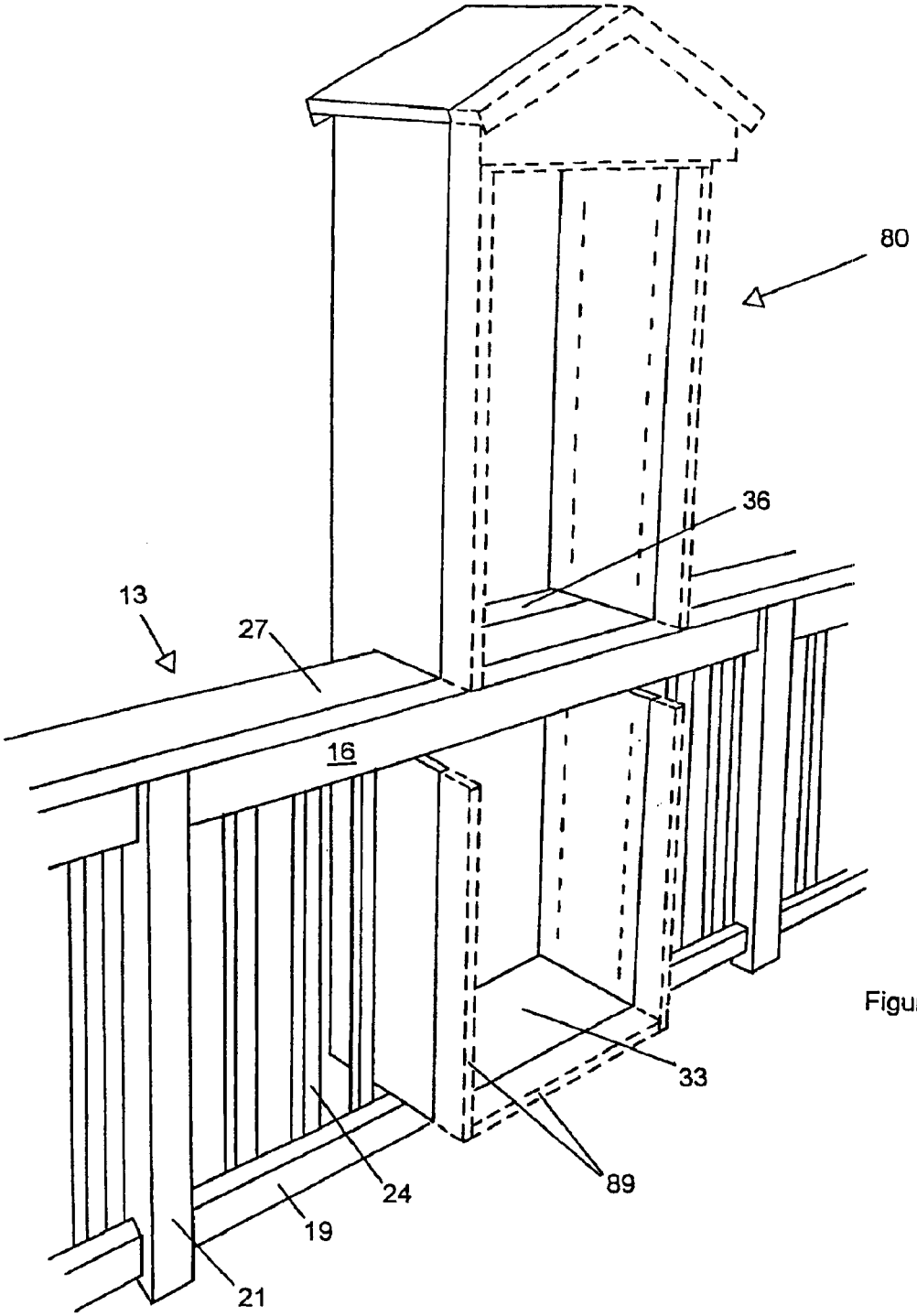
FIG. 6 shows the storage shed of FIG. 5 in an installed position, according to one embodiment of the present invention.

Once the shed enclosure assembly 80 is complete, such enclosure assembly 80 can be positioned on the deck railing 13 as illustrated in FIG. 6. Openings 45, 51 (FIGS. 2*a* and 2*b*) envelope rail cap 27 and top rail 16. Enclosure assembly 80 should be positioned near a railing post 21 to ensure structural stability. In a preferred embodiment, enclosure assembly 80 should be placed within approximately 12 inches of railing post 21. Prior to positioning enclosure assembly 80, several balusters 24 should be removed along the section of deck railing 13 selected for the location of such enclosure assembly 80. FIG. 6 shows the shed enclosure assembly 80 installed on deck railing 13. Enclosure assembly 80 may be sized so that when it is installed on railing 13, bottom panel 33 may rest on bottom rail 19. Alternately, enclosure assembly 80 may be sized so that when installed, bottom panel 33 is positioned near and above bottom rail 19. In some embodiments, such as deck constructions where bottom rail 19 is not present, bottom panel 33 may be positioned near and above the deck, or alternately may be positioned directly on the deck. Center support 36 preferably aligns with rail cap 27 to form a single shelf spanning the entire width of enclosure assembly 80.

In an alternate embodiment, left and right side panels 30, 48 can extend beyond the deck side edge of rail cap 27 as illustrated in FIG. 6 in phantom by broken lines 89. In such an embodiment, bottom panel 33 and roof panels 83, 84 should also extend beyond the deck side edge of rail cap 27.

In yet another embodiment, openings 45, 51 may be positioned on the rear edge of side panels 30, 48 with enclosure assembly 80 being locked in place by sliding the enclosure assembly 80 onto deck railing 13, and thereafter attaching back wall 54.

Figure 7:
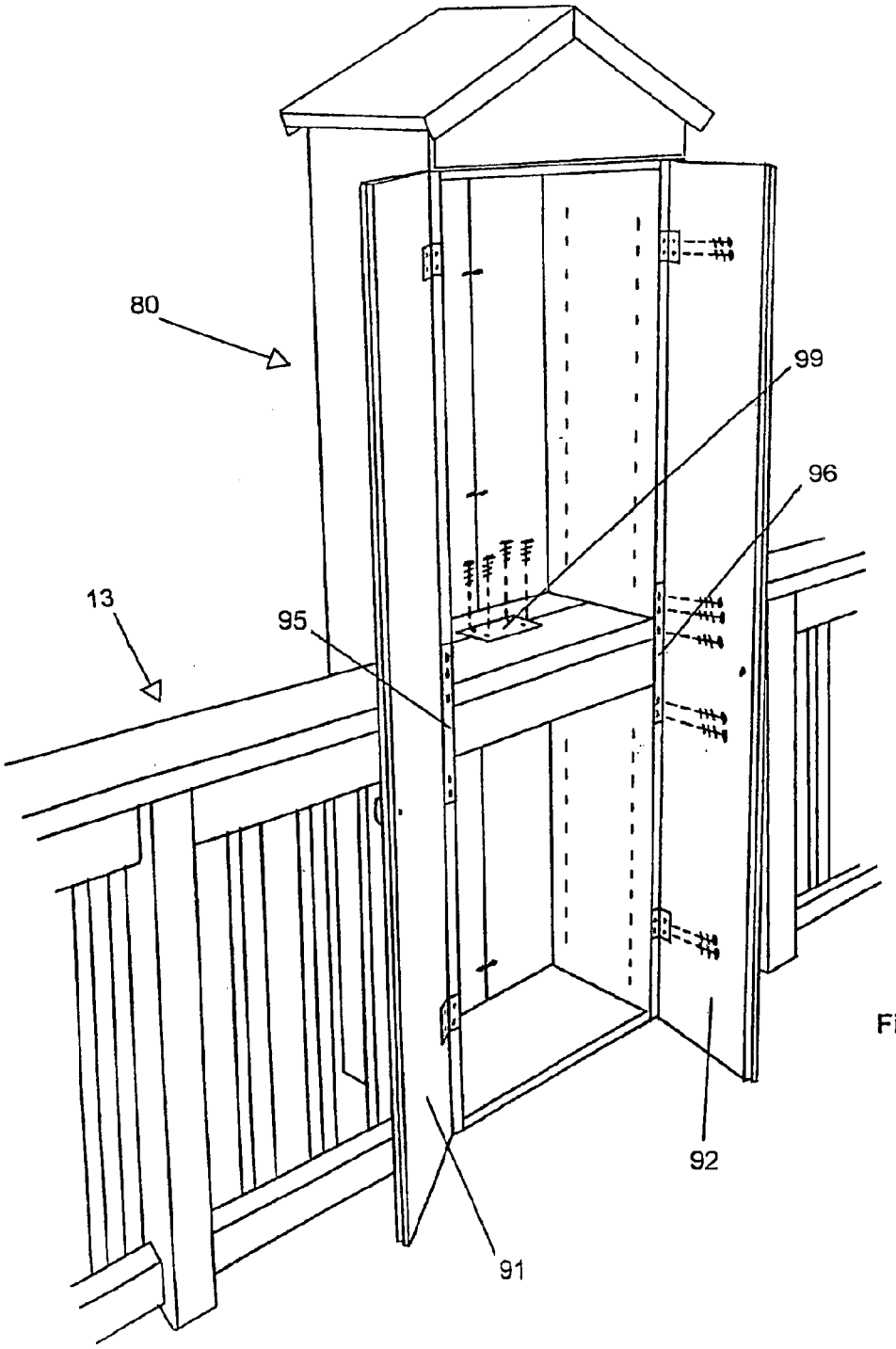
FIG. 7 shows an illustration of an exploded view of a portion of the storage shed of FIG. 1, according to one embodiment of the present invention.

Referring to FIG. 7, doors 91, 92 are attached to left and right side panels 30, 48, respectively, using suitable connectors, for example, hinges, a slider assembly, or similarly configured connectors. Rail mount brackets 95, 96 are likewise attached to left and right side panels 30, 48, respectively, using suitable fasteners. Such rail mount brackets 95, 96 prevent enclosure assembly 80 from falling off deck railing 13. In addition, to hold enclosure assembly 80 in place, a flat connector plate 99 can be secured to the center support 36 and rail cap 27. Alternatively, connector plate 99 can be secured to the bottom of center support 36 and rail cap 27.

In an alternate embodiment, left and right side panels 30, 48 extend beyond the deck side edge of the rail cap (as shown in phantom in FIG. 6). In this case, when doors 91, 92 are installed and in the closed position, a vertical open space or gap remains between the doors and rail cap 27, which vertical open space preferably extends the entire height of enclosure assembly 80. The open space enables long items, such as brooms, shovels, and rakes to be stored in enclosure assembly 80. In such an embodiment, rail mount brackets 95, 96 (FIG. 7) should be increased in their thickness dimension to fit in openings 45, 51 (FIGS. 2*a* and 2*b*) and to hold enclosure assembly 80 in place.

Figure 8:
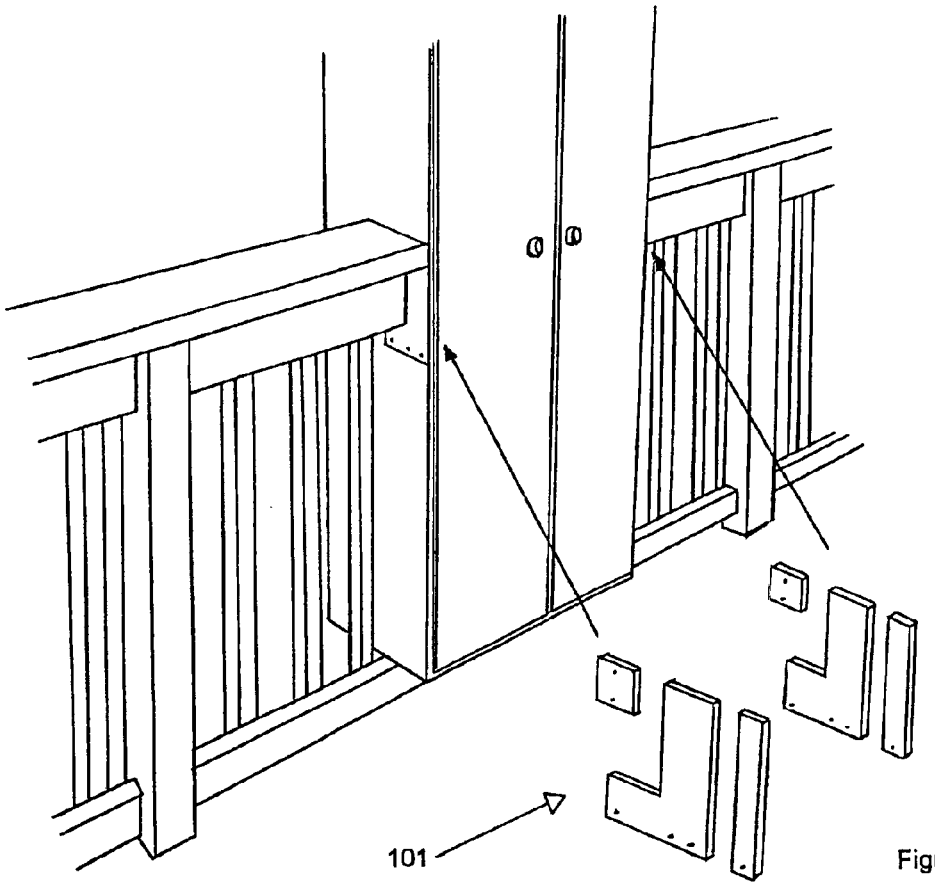
FIG. 8 shows an illustration of a portion of the storage shed of FIG. 1, according to one embodiment of the present invention.

Rail cap trim pieces, indicated generally as 101 in FIG. 8, can be added, as necessary to close remaining openings around the top rail 16 and rail cap 27. Following installation of such trim pieces, caulk, or other suitable sealant can be applied to any joint openings that might remain.

Figure 9:
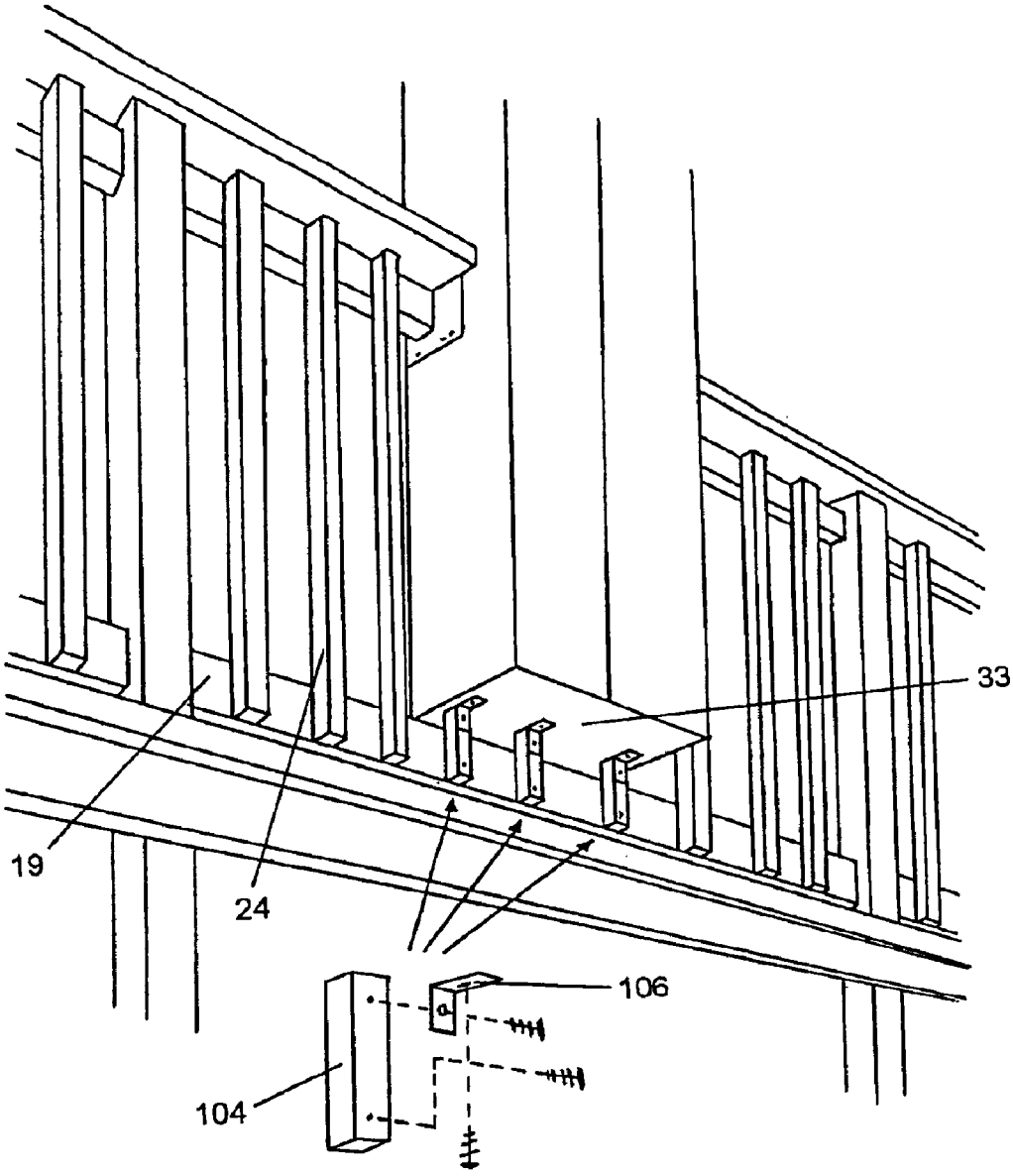
FIG. 9 shows a bottom perspective illustration of a portion of the storage shed of FIG. 1, according to one embodiment of the present invention.

As shown in FIG. 9, the bottom panel 33 is attached to bottom rail 19 or the deck, if there is no bottom rail, using short balusters, such as 104. Such short baluster 104 is sized to provide a uniform appearance in relation to the remaining full-length balusters 24. Short baluster 104 is attached to bottom panel 33 using an L-shaped bracket 106 and suitable fasteners.

Figure 10:
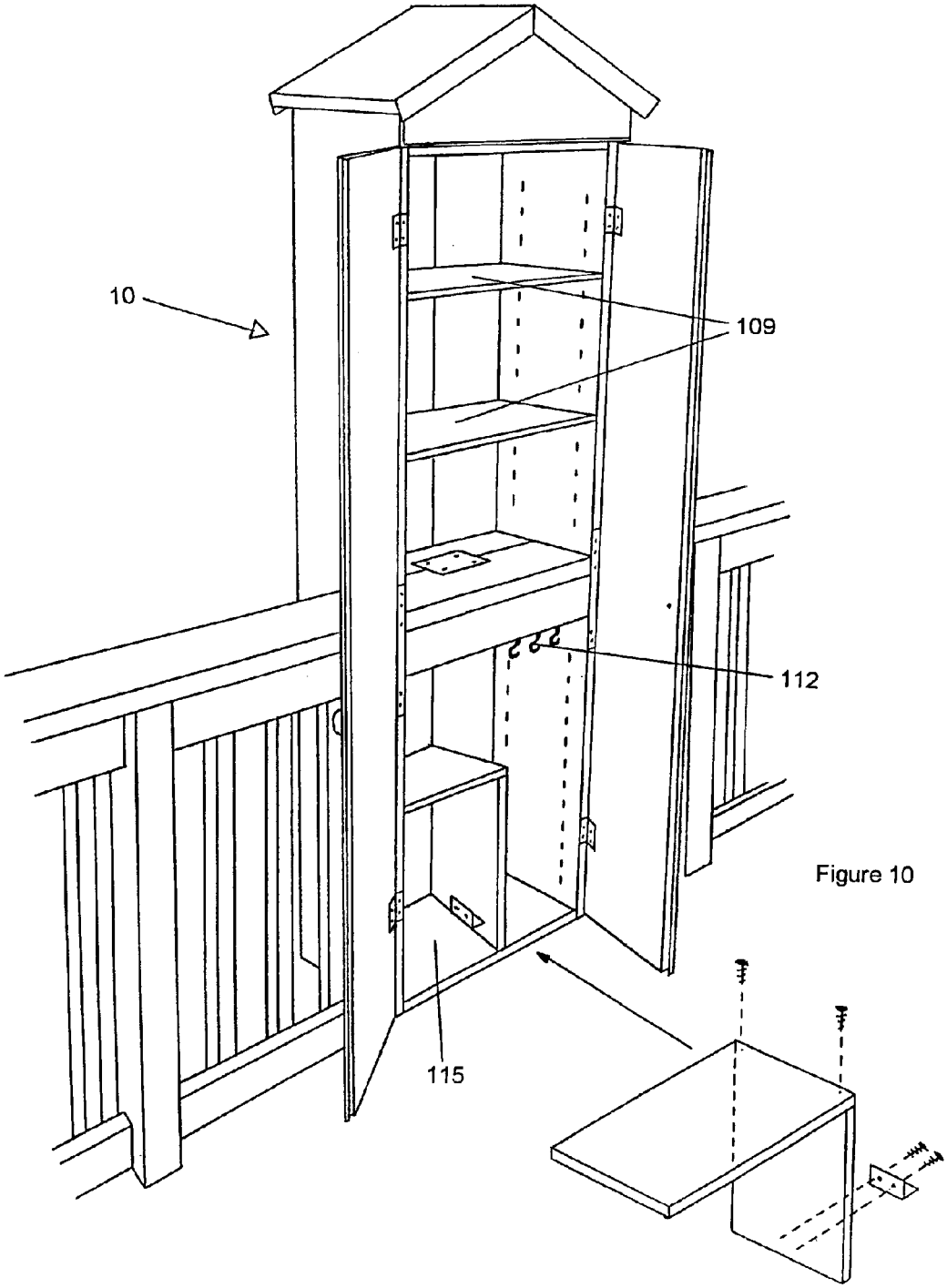
FIG. 10 shows a perspective illustration of the storage shed of FIG. 1, partially exploded, according to one embodiment of the present invention.

FIG. 10 shows a completed shed 10. After shed 10 has been installed and secured to deck railing 13, additional partitions may be added to the interior of shed 10, such as shelves 109, hooks 112, and compartment 115. A plurality of shelf pinholes may be provided on the interior surface of left and right side panels 30, 48 to permit installation of shelves 109 to a desired height. Compartment 115 can be placed in either the top portion or bottom portion of the shed 10, as desired. While not particularly shown in FIG. 10, other enhancements can be added as well (e.g., drawers, compartments, pegboard, hangers, etc.), and the placement of such partitions as shown is for illustration purposes only, and should not be considered as restrictive in any way. For example, compartment 115 can be fitted with one or more sliding drawers mounted on the interior of compartment 115, and/or one or more drawers spanning a portion or the entirety of the width of enclosure 80 may be provided between or in place of shelves 109. Likewise, a lock of traditional construction may be added which, in combination with the above-described structure of enclosure assembly 80, and by nature of its attachment to a fixed, permanent structure such as a deck railing, provides enhanced security for the items stored within enclosure assembly 80.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A storage unit adapted to be mounted to a railing, said storage unit comprising:

at least one bottom wall;

at least one back wall;

at least first and second spaced-apart side walls, wherein a. said back wall is connected to said first and second spaced-apart side walls at first and second longitudinal edges; and b. said first and second spaced-apart side walls are connected at a bottom end to said bottom wall; and at least one door, supported by at least one of said walls, wherein said door is selectively movable between a closed position and an open position, and wherein said door is adapted to obscure part of said railing between said first and second spaced-apart side walls when said door is in the closed position; wherein either of said first and second spaced-apart side walls contains a variance in its dimensions that permits the mounting of said storage unit on said railing such that said railing aligns with said side walls substantially perpendicularly.

2. The storage unit of claim 1, further comprising a roof.

3. The storage unit of claim 1, further comprising at least one support adapted for connection to at least one wall and said railing.

4. The storage unit of claim 1, further comprising at least one shelf disposed within said storage unit.

5. The storage unit of claim 4, wherein said at least one shelf is adjustable.

6. The storage unit of claim 1, wherein the variance in the dimensions of said first and second spaced-apart side walls permits a rail cap attached to said railing to be incorporated as a shelf within said storage unit.

7. The storage unit of claim 1, further comprising at least one drawer disposed within said storage unit.

8. The storage unit of claim 1, wherein said first and second side walls have an opening adapted to engage at least the top rail of said railing.

9. The storage unit of claim 1, further comprising at least one support adapted for connection to at least one wall and a deck structure to which said railing is attached.

10. The combination of a railing and a storage unit, said railing comprising at least a top rail, said storage unit comprising:

at least one bottom wall;

at least one back wall;

at least first and second spaced-apart side walls, wherein a. said back wall is connected to said first and second spaced-apart side walls at first and second longitudinal edges; and b. said first and second spaced-apart side walls are connected at a bottom end to said bottom wall; and at least one door, supported by at least one of said walls, wherein said door is selectively movable between a closed position and an oven position, and wherein said door obscures part of said railing between said first and second spaced-apart side walls when said door is in the closed position; wherein either of said first and second spaced-apart side walls contains a variance in its dimensions that permits the mounting of said storage unit on said railing such that said railing aligns with said side walls substantially perpendicularly.

11. The combination of claim 10, said storage unit further comprising a roof.

12. The combination of claim 10, wherein said first and second spaced-apart side walls have an opening adapted to engage said railing.

13. The combination of claim 10, said railing further comprising a rail cap, a bottom rail, and a railing post, said combination further comprising at least one support connected to at least one wall and to said railing.

14. The combination of claim 10, wherein said railing is attached to a deck structure, said combination further comprising at least one support connected to at least one wall and to said deck structure.

15. The combination of claim 10, further comprising at least one shelf disposed within said storage unit.

16. The combination of claim 15, wherein said at least one shelf is adjustable.

17. The combination of claim 10, said railing further comprising a rail cap, wherein the variance in the dimensions of said first and second spaced-apart side walls permits said rail cap to be incorporated as a shelf within said storage unit.

18. The combination of claim 10, further comprising at least one drawer disposed within said storage unit.

* * * * *

UNITED STATES PATENT AND TRADEMARK OFFICE

CERTIFICATE OF CORRECTION

PATENT NO. : 6,904,719 B2
DATED : June 14, 2005
INVENTOR(S) : J. Richard Braun

It is certified that error appears in the above-identified patent and that said Letters Patent is hereby corrected as shown below:

Column 6,
Line 57, the word "oven" should read -- open --.

Signed and Sealed this

Thirteenth Day of September, 2005

JON W. DUDAS
*Director of the United States Patent and Trademark Office*